US008410346B2

(12) United States Patent
Sassmannshausen et al.

(10) Patent No.: US 8,410,346 B2
(45) Date of Patent: Apr. 2, 2013

(54) BASS-DRUM PEDAL ASSEMBLY

(75) Inventors: Werner Sassmannshausen, Bad Berleburg (DE); David Schulz, Bad Berleburg (DE); Thomas Barth, Marburg (DE)

(73) Assignee: Sonor GmbH & Co. KG, Bad Berleburg (DE)

( * ) Notice: Subject to any disclaimer, the term of this patent is extended or adjusted under 35 U.S.C. 154(b) by 29 days.

(21) Appl. No.: 13/232,333

(22) Filed: Sep. 14, 2011

(65) Prior Publication Data

US 2012/0291610 A1 Nov. 22, 2012

(30) Foreign Application Priority Data

Sep. 29, 2010 (DE) ..... 10 2010 046 921

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS

| | | | | |
|---|---|---|---|---|
| 2,446,508 | A | 8/1948 | Crowell | |
| 3,464,305 | A * | 9/1969 | Remo et al. | 84/422.3 |
| 6,166,312 | A | 12/2000 | Brewster | |
| 6,188,007 | B1 * | 2/2001 | Liao | 84/422.3 |
| 6,528,714 | B1 * | 3/2003 | Liao | 84/422.3 |
| 6,632,990 | B2 | 10/2003 | Menzel | |
| 6,982,374 | B2 * | 1/2006 | Hsieh | 84/422.1 |
| 7,371,952 | B1 * | 5/2008 | Tanaka | 84/422.1 |
| 7,511,212 | B1 * | 3/2009 | Chang | 84/422.3 |
| 7,629,525 | B1 * | 12/2009 | Lin | 84/422.1 |
| 7,696,422 | B1 * | 4/2010 | Chang | 84/422.1 |
| 7,709,716 | B1 * | 5/2010 | Chen | 84/422.1 |
| 8,212,133 | B2 * | 7/2012 | Chen | 84/422.1 |
| 2012/0291610 | A1 * | 11/2012 | Sassmannshausen et al. | 84/422.1 |

FOREIGN PATENT DOCUMENTS

| | | | |
|---|---|---|---|
| DE | 352883 | B | 5/1922 |
| DE | 3327687 | A | 2/1985 |
| EP | 1237147 | A | 9/2002 |

* cited by examiner

*Primary Examiner* — David Warren
*Assistant Examiner* — Robert W Horn
(74) *Attorney, Agent, or Firm* — Andrew Wilford

(57) ABSTRACT

A pedal assembly for a drum has a floor plate, a clamp for securing the floor plate to a hoop of a drum, a pivot on the floor plate, a post pivotal on the pivot of the floor plate between an erect operating position extending upward from the floor plate and a transport position recumbent on the floor plate. An upper end of the post is adapted to hold a beater shaft. A pedal pivotal on the plate is couplable to the beater shaft. A latch releasably locks the post in at least the operating position.

9 Claims, 5 Drawing Sheets

BASS-DRUM PEDAL ASSEMBLY

FIELD OF THE INVENTION

The present invention relates to pedal assembly. More particularly this invention concerns a single bass-drum pedal assembly.

BACKGROUND OF THE INVENTION

A standard bass-drum pedal assembly has at least one post extending upward from a floor plate and in which at least one drum beater carried on a shaft is pivotal and movable against the force of at least one return spring by a mechanism actuatable by a pedal. Such a pedal assembly is attached to a section of a circular hoop of a bass drum. When the pedal is depressed by the foot of the percussionist, the beater strikes the skin of the drum.

A pedal assembly of this type that functions to transmit the foot action of the drummer quickly and precisely to the percussion instrument, for example, a bass drum, has been disclosed in DE 352 883 and DE 33 27 687.

A pedal assembly disclosed in EP 1 237 147 has two drum beaters that are operated by a two-part pedal with respective actuating mechanisms. A base of this pedal assembly comprises a floor plate carrying two posts at an outer end close to the bass drum and extending upward at right angles from the floor plate. These posts are detachably mounted to the floor plate by a screw/plug-in connection. They are interconnected by a shaft carrying the drum beaters and project vertically upward when fixed to the base so that the pedal assembly as a whole has a large overall height that, in particular, is difficult to transport. Since a drum kit is always a difficult item to set up, take down, and transport, this bulky pedal assembly is an extra problem.

As has been disclosed, for example by U.S. Pat. No. 6,166,312 and U.S. Pat. No. 2,446,508, the pedal assembly is fastened by a clip or a clamp to the hoop of the bass drum, the clip or clamp being tightly attached to the pedal assembly. Clamps of this type are composed of top and bottom clamp parts or jaws that grip the hoop. This attachment between pedal assembly and hoop must be disengaged or reclamped each time the bass drum is disassembled or assembled.

U.S. Pat. No. 6,632,990 discloses a clamping claw that secures a pedal assembly to a percussion instrument. Here the clamping claw is clamped in place on the hoop of the bass drum independently of the pedal assembly, then attached to the pedal assembly. During disassembly and assembly, the clamping claw remains in the clamped-in-place state on the hoop of the bass drum. First of all, the clamping claw that is clamped in place and projects beyond the circumferential rim of the hoop can interfere with transporting the bass drum, especially when the drum kit is designed to nest, and secondly, what is involved here is an attachment system that is composed of multiple individual parts.

OBJECTS OF THE INVENTION

It is therefore an object of the present invention to provide an improved drum pedal assembly.

Another object is the provision of such an improved drum pedal assembly that overcomes the above-given disadvantages, in particular that on the one hand can, in particular, be easily stowed and transported, yet on the other hand simultaneously provides simple and effectively manipulated attachment to the hoop of a percussion instrument.

SUMMARY OF THE INVENTION

A pedal assembly for a drum has according to the invention a floor plate, a clamp for securing the floor plate to a hoop of a drum, a pivot on the floor plate, a post pivotal on the pivot of the floor plate between an erect operating position extending upward from the floor plate and a transport position recumbent on the floor plate. An upper end of the post is adapted to hold a beater shaft. A pedal pivotal on the plate is couplable to the beater shaft. A latch releasably locks the post in at least the operating position.

Due to the pivot attachment of the post, this post, after unlocking, can easily be retracted by hand out of its vertically oriented operating position into a horizontal transport position running parallel to the floor plate or to the pedal of the pedal assembly. This thus enables the complete pedal assembly to be made compact for space-saving transport, without having to laborious disassemble the post or posts.

In an advantageous proposal of the invention, provision is made whereby the post is provided at its lower end with a hub-like bushing that is supported by its outer circumference on a concave integral bearing block of a hinge base attached to the floor plate, and is rotatably seated on a pivot eye by an axially lateral bushing opening that with its inner surface concentrically surrounds a projecting collar of the pivot eye. The post is thus both securely supported in its operating position, and also radially guided during pivoting by the bearing block support while having good lateral guidance due to the flat contact against the pivot eye.

In order to ensure a stable, chamber-like enclosed storing receptacle, both the bushing and the pivot eye are preferably provided with an inner wall or partition wall that extends over the entire diameter and is spaced some distance from their respective ends.

In a preferred embodiment of the invention for locking and unlocking the post, the bushing and the pivot eye are provided at their mutually engaging circumferential surfaces with aligned detent notches. A spring-loaded coupling with detent lobes is provided between the inner wall of the bushing and the inner wall of the pivot eye and engages both the detent notches of the bushing and also of the pivot eye. This advantageously achieves the result that the post is locked by the detent lobes of the coupling so as to be secured against movement both in the vertical operating position and also in the horizontal transport position.

The coupling itself can be advantageously supported on a shaft that is passed through the inner walls and a spring, where the spring is located between the inner wall of the bushing and the coupling.

In order to move the coupling out of locking engagement with the pivot eye, an actuator in the form of a button, provided according to the invention with axially projecting tension legs, is provided on the pivot eye. The tension legs extend through openings provided in the inner wall of the pivot eye and impinge on the coupling against the force of the spring. The coupling here is pressed completely into the bushing of the post, thereby releasing the locking engagement of the detent lobes with the detent notches of the pivot eye. The post can now pivot freely. As soon as the actuator is no longer pushed in by the pressure of a finger and the detent lobes of the coupling are aligned with the detent notches of the pivot eye, the spring releases and presses the coupling back into locking engagement with the pivot eye.

In another embodiment of the invention, provision is made whereby the side of the post that faces the hoop of the percussion instrument is provided with a clamping element, advantageously an adjustment screw, thereby allowing for adjustments to varying thicknesses of the hoops, which element impinges upon a clamping lever pivotable connected to the hinge base when the post is in the erected and locked operating position, the lever acting on the hoop accommodated by the hinge base. The pedal assembly is fixed in place, secured against movement, on the hoop of the bass drum due to this simple but nevertheless effective clamping attachment that is simultaneously achieved by the erected and locked post in its operating position.

BRIEF DESCRIPTION OF THE DRAWING

The above and other objects, features, and advantages will become more readily apparent from the following description, reference being made to the accompanying drawing in which:

FIG. 6*a* shows the hinge base from the side facing away from the post attachment while FIG. 6*b* shows it from the post attachment side;

FIG. 7*a* shows the coupling from the front while FIG. 7*b* shows it from the back;

FIG. 8*a* shows the clamping lever from the bottom while FIG. 8*b* shows it from the top; FIG. 9*a* is a side view of the actuator, FIG. 9*b* is a bottom view of the means, and FIG. 9*c* shows it as viewed from the actuation side.

DETAILED DESCRIPTION

Figure 1:
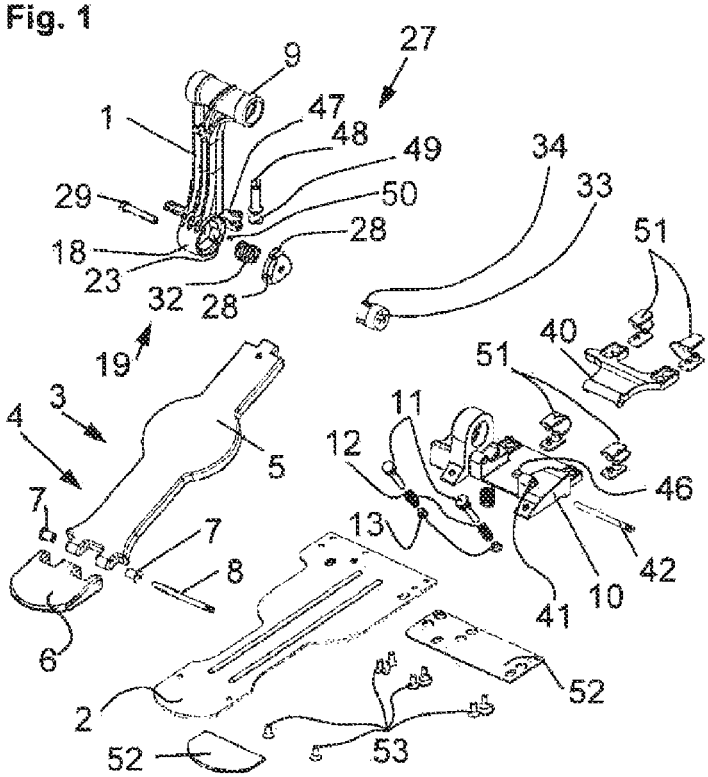
FIG. 1 is an exploded view of a pedal assembly provided with a pivotable post.
Figure 2:
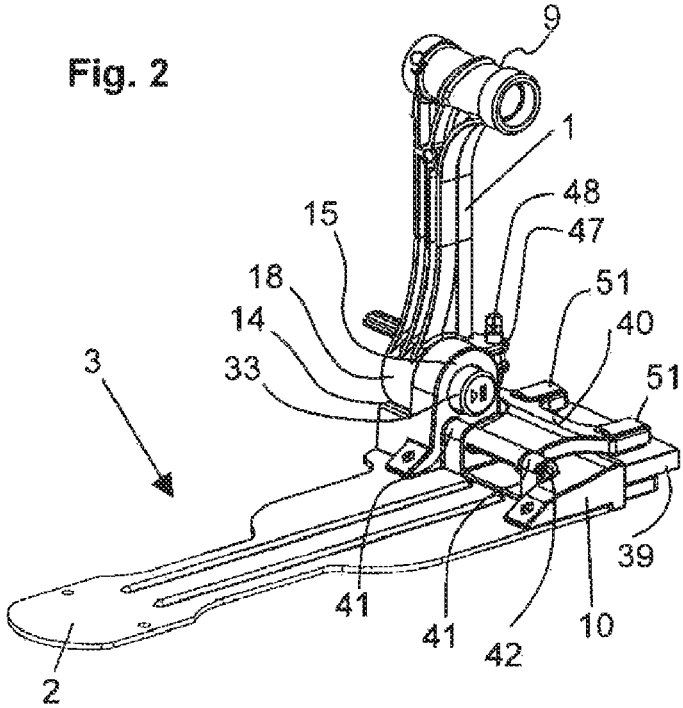
FIG. 2 is a perspective view showing the pedal assembly of FIG. 1 as a completely assembled unit.
Figure 3:
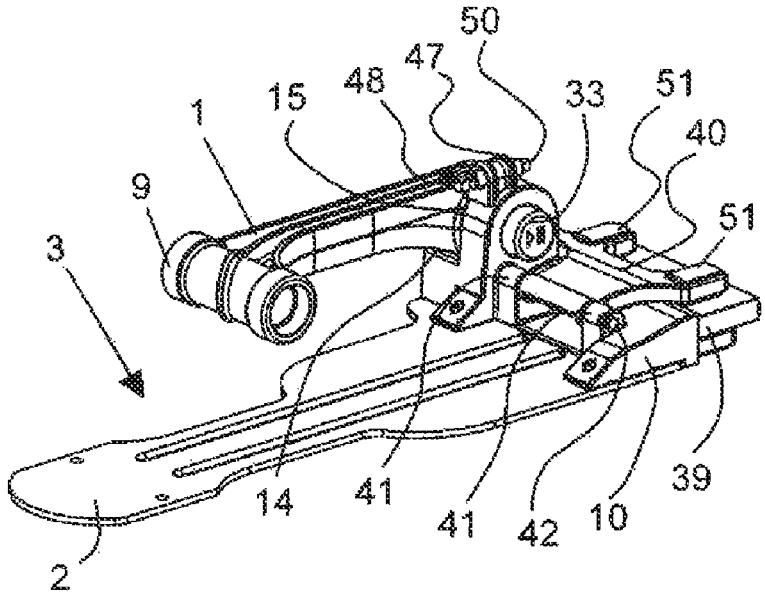
FIG. 3 shows the pedal assembly of FIG. 2 with the post pivoted into the horizontal position.

As seen in FIGS. 1-3 a pivotable cast-metal post 1 provided with a locking and unlocking mechanism is carried on a sheet-metal floor plate 2 of a pedal assembly 3. The plate 2 is attached to a hoop 39 (FIGS. 2-4) of an otherwise unillustrated base drum. The pedal assembly comprises a foot pedal 4 in turn comprised of a foot plate 5 and a heel plate 6 pivoted to each other by bearing bushings 7 and a knurled pin 8. The pedal 4 sits on the floor plate 2, and is attached, for example, by an unillustrated chain or a strap to an arm extending from a shaft 54 pivotal in a sleeve-like seat head 9 of the post 1. This shaft 54, which is standard, has another arm 55 carrying a drum beater 56 that is deflected onto the skin of the drum when the pedal 4 is depressed, as shown in several of the above-cited references that are herewith incorporated by reference. An unillustrated tension spring is typically hooked between one of the arms of the shaft 54 and the floor plate 2 to urge the beater 56 into a retracted position and the pedal 4 into an up position.

A hinge base 10 forward of the foot pedal 4 is solidly attached by knurled screws 11, compression springs 12, and rivets 13 to the floor plate 2. To achieve the inventive pivotal or collapsible mounting of the post 1, the hinge base 10 has an upwardly concave part-cylindrical bearing block 14 and a pivot eye 15 that defines a horizontal pivot axis 16 transverse to the base plate 2 and that is provided with an axially projecting collar 17 on the outer side facing the bearing block 14 (see FIG. 6*b*).

The post 1 is provided at its bottom end with a hub-like bushing 18 that rides with its part-cylindrical outer surface in the part-cylindrical seat of the bearing block 14, and concentrically fits around the collar 17 with a cylindrical hole 19 centered on the axis 16 and facing the pivot eye 15.

The bushing 18 and the pivot eye 15 are provided with respective inner crosswise partition walls or webs 20 and 21 spaced inward from their outer ends and extending perpendicular to the axis 16. Around its inner periphery 22 in the region between the inner web 20 and the outer mouth of the hole 19, the bushing 18 has three identical detent notches 23 that open radially inward and are angularly equispaced about the axis at 120°.

Figure 5A:
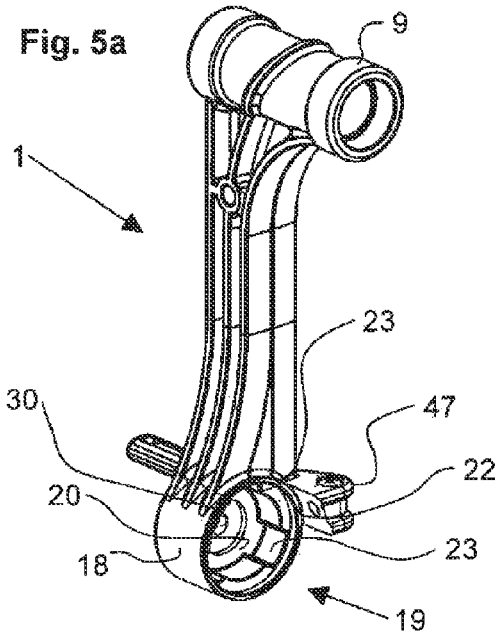
FIGS. 5*a* through 5*c* are various perspective views showing the post in detail.
Figure 5B:
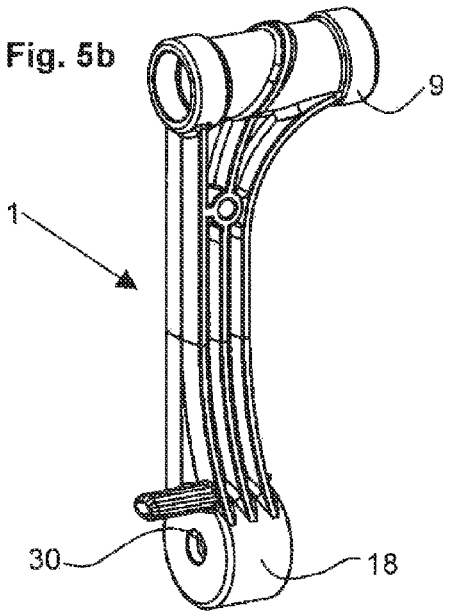
Figure 5C:
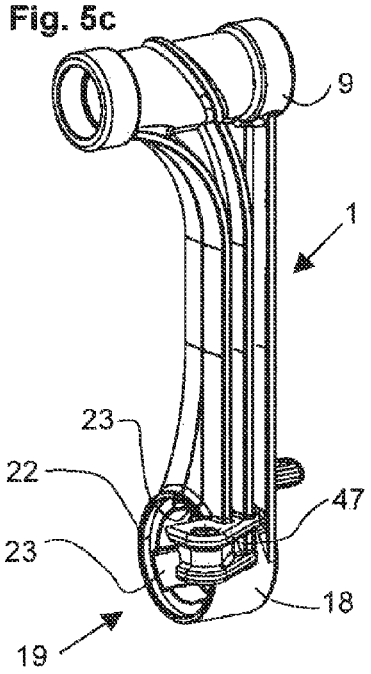
Figure 6A:
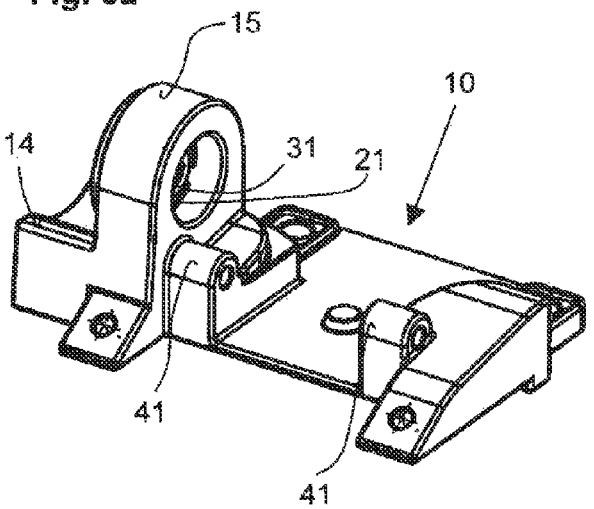
FIGS. 6*a* and 6*b* are perspective views showing in detail the hinge base of the pedal assembly of FIG. 1, where
Figure 6B:
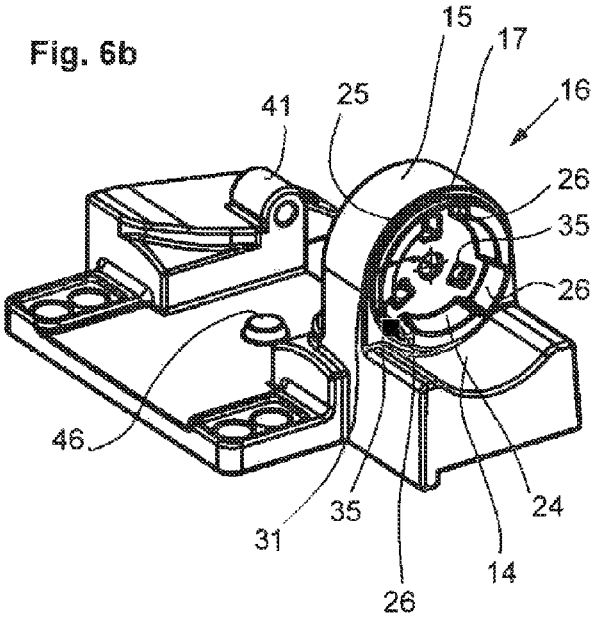

The pivot eye 15 is similarly formed around its inner surface 24 in the region between the respective inner web 21 and the outer end 25 of the collar 17 with similar detent notches 26 that are similarly disposed relative to each other at an equiangular spacing of 120° (see also FIGS. 5*a*, 5*c*, and FIG. 6*b*).

Figure 7A:
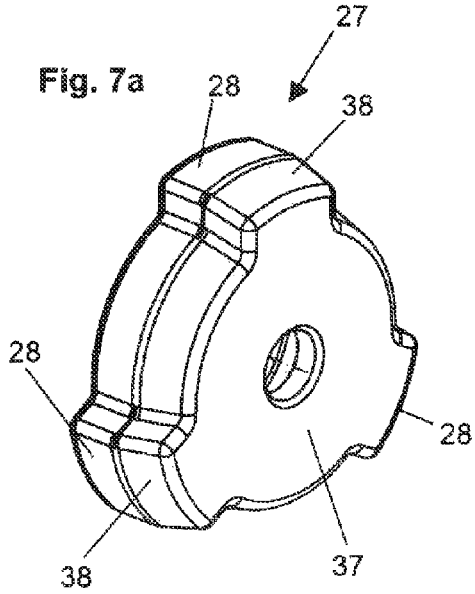
FIGS. 7*a* and 7*b* are perspective views showing in detail a coupling of the pedal assembly of FIG. 1, where
Figure 7B:
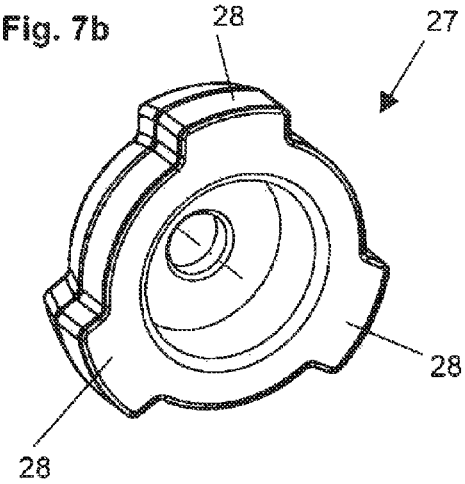
Figure 8A:
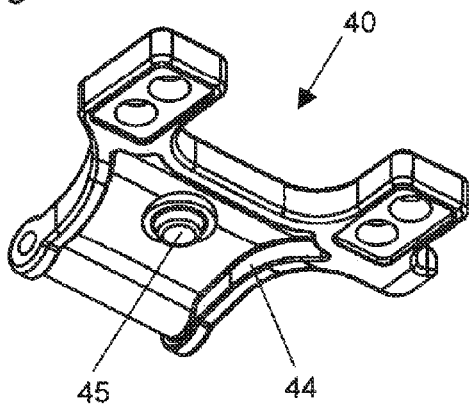
FIGS. 8*a* and 8*b* are perspective views showing in detail a clamping lever of the pedal assembly of FIG. 1, where
Figure 8B:
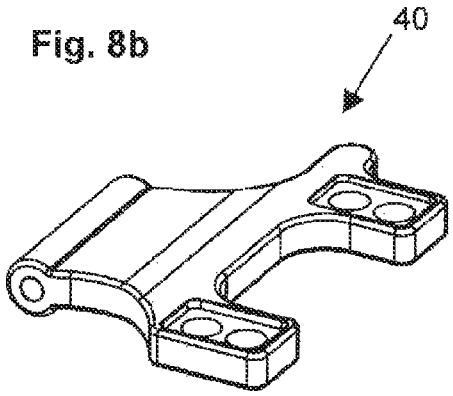

An axially tapered coupling 27 is engageable with the inner walls 20 and 21 of the bushing 18 and the pivot eye 15 and is formed with detent lobes 28 that are disposed relative to each other at an angular spacing of 120° (see also FIGS. 7*a* and 7*b*) and shaped to fit with the notches 23 and 26. This coupling 27 can slide axially on a shaft 29, here a socket screw, that passes along the axis 16 through cylindrical apertures 30 and 31 defined by the inner peripheries of the walls 20 and 21 and through a compression spring 32 (FIG. 1) between the coupling 27 and the inner wall 20. Thus in a latching position this spring 32 presses the coupling 27, while it is engaged with the notches 23 of the post 1, into engagement with the notches 26 of the eye 15.

Figure 9A:
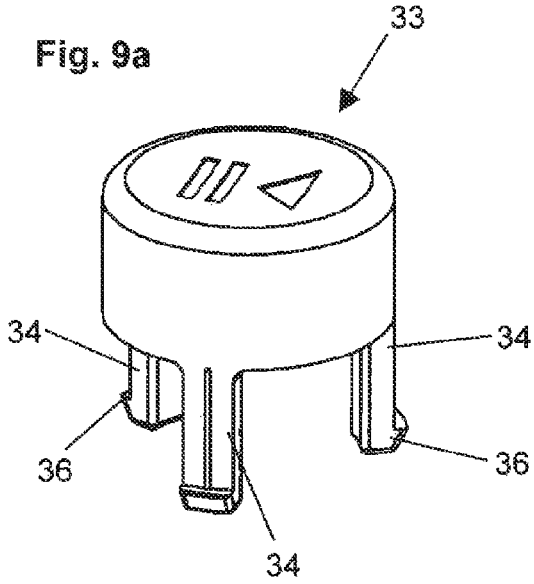
FIGS. 9*a* through 9*c* are perspective views showing in detail an actuator of the pedal assembly of FIG. 1, where
Figure 9B:
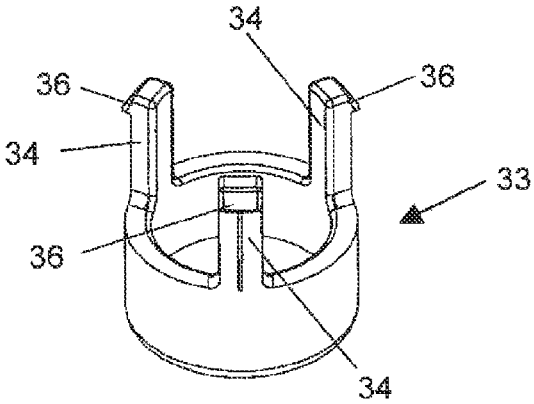
Figure 9C:
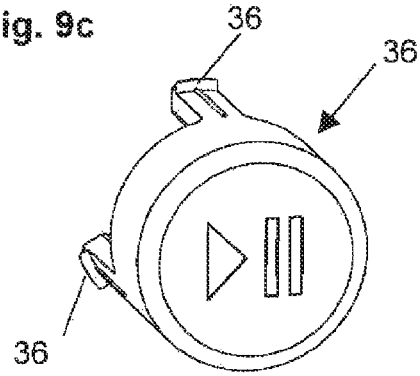

The coupling 27 is engaged by an actuating button 33 that is inserted from the inside into the pivot eye 15 and that is provided for this purpose with axially projecting spring legs 34 (see FIGS. 9*a* through 9*c*) that extend through openings 35 in the inner wall 21 of the pivot eye 15 and press axially outward on an inner face 37 of the coupling 27. After the barbs 36 have passed through the openings 35, they engage behind the inner wall 21 and thus form an end stop for the button 33, preventing axial inward movement of the button 33.

In the erect operating position of the post 1 illustrated in FIG. 2, the compression spring 32 is compressed and the coupling 27 with its detent lobes 28 in the latching position locking engagement with the notches 23 of the bushing 18 and the notches 26 of the pivot eye 15.

Figure 4:
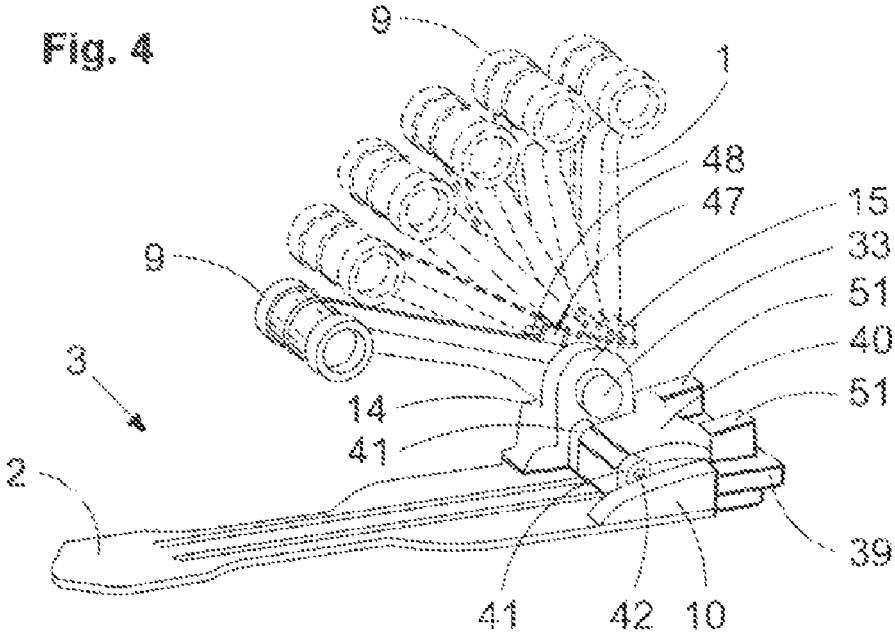
FIG. 4 shows the pivoting action by the post of FIGS. 2 and 3.

In response to actuation, that is axial pressing outward (toward the left in FIG. 6*a*), of the button 33, the coupling 27 is pressed far enough into the bushing 18 by the tension legs 34 against the force of the compression spring 32 that the lobes 28 are disengaged from the detent notches 26 of the pivot eye 15 by axial outward movement of the coupling 27 into a freeing position only engaging the notches 23. The post 1 can now be pivoted into the horizontal transport position of FIG. 3 as also shown in FIG. 4.

As soon as button 33 is no being longer actuated and the detent lobes 28 are aligned with the detent notches 26 of the pivot eye 15, that is when the post 1 has assumed its transport position, the compression spring 32 releases and moves the coupling 27 with the detent lobes 28 into locking engagement with the pivot eye 15, thereby retaining the post 1 in the lowered or transport position.

The coupling 27 is provided on its inner face 37 directed axially toward the pivot eye 15 with chamfers 38 (see FIG. 7*a*) so as to facilitate locking engagement and fitting with the detent notches 26.

After the button 33 is once again actuated and as with the above-described pivoting action from erect to recumbent position, the post 1 can be pivoted back into the erect operating position of FIG. 2.

In this operating position the entire assembly 3 is latched to the hoop 39, illustrated only schematically, (FIGS. 2 and 3) of, for example, a bass drum. To this end, a cast-metal clamping lever 40 is pivotally mounted on the hinge base 10 by a knurled pin 42 that passes through bearing eyes 41 formed on the plate 10. The lever 40 here is biased counterclockwise by a compression spring 43 (FIG. 1) engaged between a centering pin 45 on the bottom 44 of the lever 40 and a centering pin 46 on the base 10.

The post 1 is provided with a bracket 47 at its lower end adjacent the bushing 18 in order to press down or apply pressure against the lever 40. The bracket has an adjustment screw 48 that is adjustably attached to the bracket 47 by a vibration-damping pad 49 and a securing plate 50. Thus, when in its operating position, the post 1 is pressed tightly by the screw 48 via the lever or part 40 against the hoop 39 resting on the hinge base 10, both the lever 40 and the hinge base 10 being provided with flexible and material-protecting PU strips 51. Thus the hoop 39 is clamped between the lever 40 and the cast-metal hinge base 10 fixed to the floor plate 2

In addition, the bottom of the floor plate 2 is provided with antiskid rubber sheets 52 that is screwed tightly onto the floor plate 2 by countersunk screws 53.

We claim:

1. A pedal assembly for a drum, the assembly comprising:

a floor plate;

clamp means for securing the floor plate to a hoop of a drum;

a pivot on the floor plate;

a post pivotal on the pivot of the floor plate between an erect operating position extending upward from the floor plate and a transport position recumbent on the floor plate, an upper end of the post being adapted to hold a beater shaft;

a pedal pivotal on the plate and couplable to the beater shaft; and latch means for releasably locking the post in at least the operating position.

2. The pedal assembly defined in claim 1, wherein the floor plate is provided with an eye defining a horizontal axis and the post has a lower end formed with a bush journaled in the eye for pivoting of the post about the axis between the positions.

3. The pedal assembly defined in claim 2, wherein the floor plate forms an upwardly open part-cylindrical seat centered on the axis and the post lower end fits complementarily in the seat.

4. The pedal assembly defined in claim 1, wherein both the eye and the bushing have respective internal transverse webs axially confronting each other and relatively rotatable on pivoting of the post on the plate.

5. The pedal assembly defined in claim 4 wherein the webs are each formed with a notch and the notches are axially aligned in the operating position of the post, the assembly comprising:

a spring-loaded coupling engageable in the operating position of the post in both of the notches to lock the post against pivoting on the floor plate and disengageable from at least one of the notches to permit such pivoting.

6. The pedal assembly defined in claim 5, further comprising:

a shaft extending axially through the bushing and eye; and a spring surrounding the shaft and braced between the coupling and the bushing to urge the coupling axially inward into engagement with the one notch.

7. The pedal assembly defined in claim 6, further comprising:

an actuator braced axially outward against the coupling and shiftable axially inward to disengage the coupling from the one notch.

8. The pedal assembly defined in claim 7, wherein the actuator is a button having legs extending axially through the web of the eye and limiting axial inward travel of the button relative to the eye.

9. The pedal assembly defined in claim 1, further comprising a formation on the post engageable only in the operating position of the post with the clamp to hold same in a closed position gripping the hoop.

* * * * *